United States Patent [19]

MacKirdy

[11] Patent Number: 4,688,305

[45] Date of Patent: Aug. 25, 1987

[54] HINGE HAVING ALTERNATE MOUNTING CAPACITY

[75] Inventor: William T. MacKirdy, Scot Run, Pa.

[73] Assignee: Casket Shells Inc., Eynon, Pa.

[21] Appl. No.: 727,358

[22] Filed: Apr. 25, 1985

[51] Int. Cl.[4] ..... A61G 17/00; E05D 7/10; E05D 11/10

[52] U.S. Cl. ..... 27/16; 27/2; 16/266; 16/353

[58] Field of Search ..... 27/2, 14, 16, 18, DIG. 1; 16/265, 266, 351, 353, 355, 356, 267, 268, 257, DIG. 13, 253

[56] References Cited

U.S. PATENT DOCUMENTS

| | | | |
|---|---|---|---|
| 437,492 | 9/1890 | Herrick | 27/16 |
| 470,291 | 3/1892 | Dowling | 27/18 |
| 601,823 | 4/1898 | Allen | 27/18 |
| 1,165,063 | 12/1915 | Breehl | 16/266 X |
| 1,934,635 | 11/1933 | Davoran | 27/14 X |
| 2,708,302 | 5/1955 | Wilkirson | 27/2 |
| 2,874,987 | 2/1959 | Cole | 27/DIG. 1 X |
| 3,416,185 | 12/1968 | Peterson | 27/16 X |
| 3,952,369 | 4/1976 | Erickson | 16/DIG. 13 |

FOREIGN PATENT DOCUMENTS

| | | | |
|---|---|---|---|
| 564161 | 9/1958 | Canada | 27/16 |
| 1319594 | 6/1973 | United Kingdom | 16/257 |

*Primary Examiner*—Robert A. Hafer

*Assistant Examiner*—Terrence L. B. Brown

*Attorney, Agent, or Firm*—Kane, Dalsimer, Kane, Sullivan and Kurucz

[57] ABSTRACT

A hinge is adapted to be mounted in either of two mountings, a first or flush mounting which enables closing of a cover so that it touches a container portion, and a second or spaced mounting in which the cover is maintained in spaced relation to the container portion. The hinge comprises a strap which is detachably coupled to a hinge base. The strap comprises a strap plate and at least two hooks affixed thereto. The hinge base comprises a hinge plate having an aperture in a center portion thereof a vertically protruding arcuate rib, and a support bar. In a first mounting the strap is detachably and rotatably mounted on the support bar of the hinge base so that both hooks of the strap are mounted on the support bar. In the second mounting the cover is initially detached from the container, laterally displaced along the axis of the support bar, and replaced so that only one of the hooks is mounted on the support bar. In this position the vertically protruding rib portion of the hinge base contacts the strap plate, maintaining the strap plate in a position parallel to and spaced from the hinge plate. As a result the cover is maintained parallel to and spaced from the container. In addition, if the cover is a two part cover, the second mounting maintains the two covers in positions spaced from one another.

6 Claims, 10 Drawing Figures

20

HINGE HAVING ALTERNATE MOUNTING CAPACITY

BACKGROUND OF THE INVENTION

This invention pertains to hinges in general and more particularly to a hinge for use on a burial casket which is adapted to couple a cover to a container in either of two alternate mountings.

A casket shell generally comprises a container or body part and a lid hingedly coupled thereto. The lid may comprise a single piece, or be of the two part, half-shell type.

Manufacture of the casket shell includes forming the casket body and lid, affixation of the necessary and desired hardware (hinges, etc.), and surface heating of the casket shell. The container and lid are usually composed of one of various grades of steel, zinc, copper, or bronze. Surface treating of the casket shell commonly includes the steps of painting, lacquering, then baking. As can be appreciated from the numerous steps involved and the care taken in surface treatment of a casket shell, such emphasis is placed upon surface appearance in the burial casket manufacturing industry.

It is desired to surface treat an entire casket shell as a unit to insure uniform treatment and to reduce the costs of surface treatment. In present surface treatment processes the casket lid is rotated to an open position and the lid and container surfaces are treated. At the hinge and at the areas where one shell component is located proximate to another, experience has shown that surface treatment of the casket shell is very difficult.

Cracking and breaking of paint and lacquer at points where one member of the casket contacts, or comes very close to another member of the casket, is common when using conventional casket hinges. In addition, after painting a casket shell, paint which has been applied to the surface of one member will adhere to the surface of an adjoining contacting member resulting in damage to the painted finish. In addition, good baking at this location is usually not possible thus limiting the quality of surface appearance and longevity of the surface finish.

As can be seen from the above, in order to enable uniform surface treatment of a casket lid and base without cracking about points where one casket lid touches another a solution to the above-noted problem is necessary.

SUMMARY OF THE INVENTION

The present invention comprises a hinge which is directed to overcoming the aforenoted problems in prior art surface treating of casket shells, while, in addition, serving to preserve the finish of the casket shell. The present hinge enables the mounting of a casket lid to a casket container in either a flush mounting or a spaced mounting.

To this end the present invention provides a hinge having a strap which is detachably coupled to a hinge base. The strap comprises a strap plate and at least two hooks affixed thereto. The hinge base comprises a hinge plate having an aperture in a center portion thereof, a vertically protruding arcuate rib, and a support bar. In a first or flush mounting the strap is detachably and rotatably mounted on the support bar of the hinge base so that both hooks of the strap are mounted on the support bar. In the second or spaced mounting the cover is initially detached from the container, laterally displaced along the axis of the support bar, and replaced so that only one of the hooks is mounted on the support bar. In this position the vertically protruding rib portion of the hinge base contacts the strap plate, maintaining the strap plate in a position parallel to and spaced from the hinge plate. As a result the cover is maintained parallel to and spaced from the container. When the cover is a two part cover, the second mounting maintains the two covers in positions spaced from one another.

A primary object of the present invention is to facilitate the surface treatment of an assembled casket shell so that a uniform surface treatment may be applied thereto in a minimum number of steps.

Another object of the present invention is to provide a hinge which is adapted to maintain the casket lid in a spaced relation with the casket body in order to preserve the casket shell finish.

A further object of the present invention is to provide a hinge which enables lateral displacement of a casket lid so that in a half-shell casket a first lid portion is maintained in a position spaced from a second lid portion.

Another object of the present invention is to provide a hinge which allows lateral displacement of a casket lid while also providing conventional pivotal rotation of the lid about the casket body.

These and other objects and advantages will become apparent from the following detailed description which is to be taken in conjunction with the accompanying drawings.

DETAILED DESCRIPTION OF THE PREFERRED EMBODIMENT

Figures 7, 9:
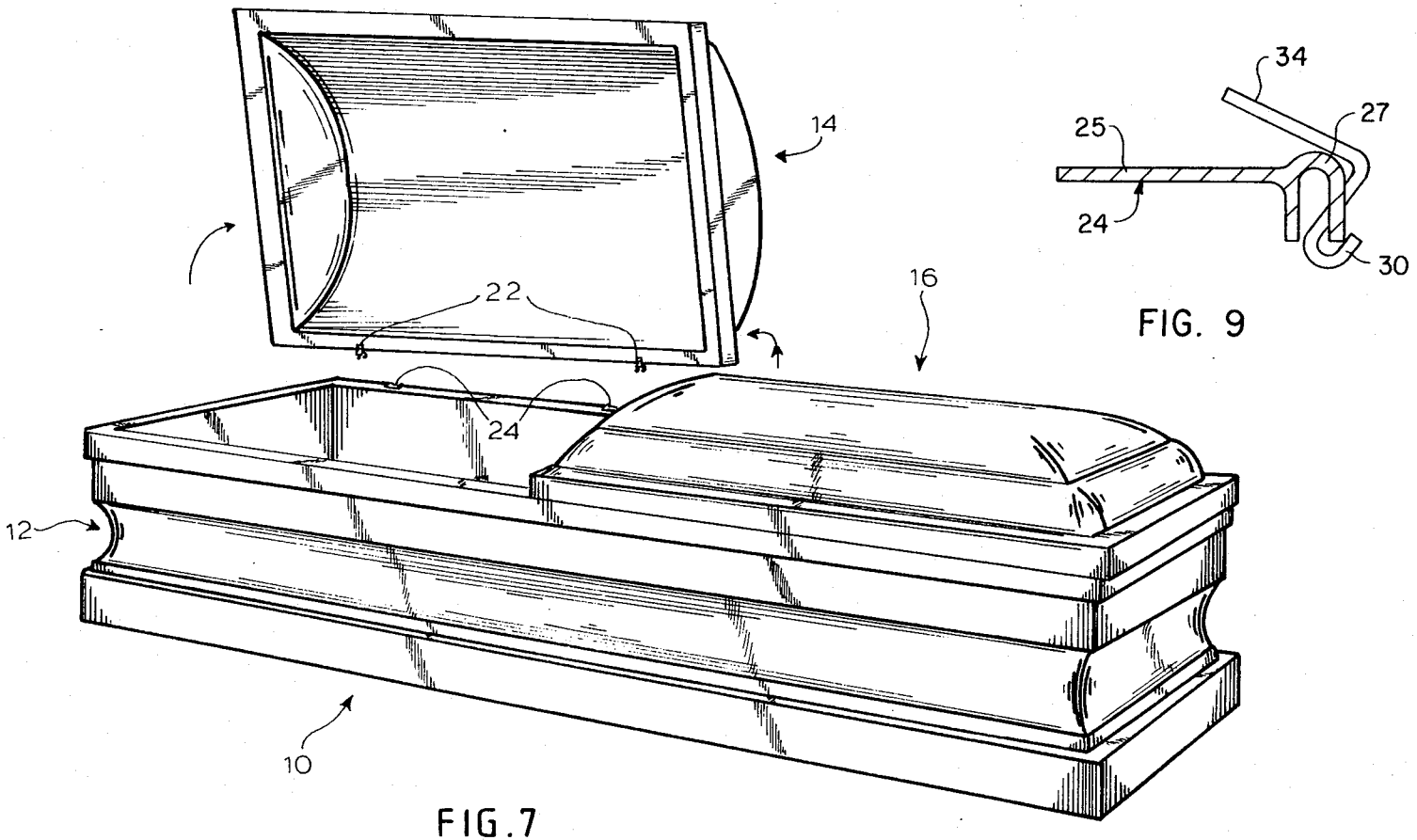
FIG. 7 is a perspective view of a casket in which one of the half-lid members has been detached from the casket body by detaching the hooked strap from the hinge base.
FIG. 9 is a side elevation view showing the hinge in the spaced mounting of FIG. 5.

In the drawings a casket body 10 is shown having a base 12 and a lid comprising half-lid members 14 and 16. As best illustrated in FIG. 7 two hooked straps 22 are affixed to half-lid 14 by any conventional means; e.g. a machine screw. Two hinge bases 24 are affixed to casket body 10.

Figure 6:
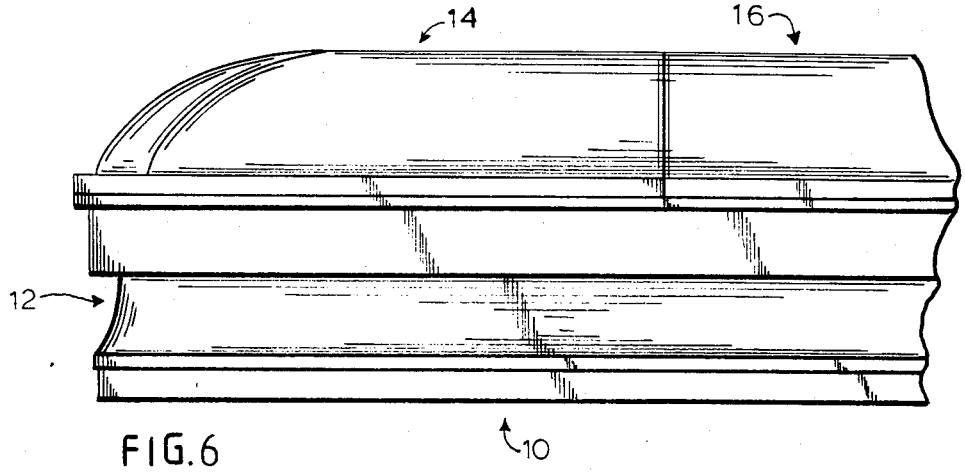
FIG. 6 is a rear view of a half-shell casket which employs the present hinge wherein the hinge is positioned as shown in FIG. 2.

The present hinge is adapted to allow closing of half-lid 14 in either of two conditions, the first illustrated in FIG. 6, the second illustrated in FIG. 9. FIG. 6 illustrates half-lid 14 closed in a manner in which it is flush with casket base 12. FIG. 9 illustrates the alternate or spaced mounting provided by hinge 20 wherein half-lid 14 is vertically and laterally (see FIG. 8) spaced from lid 16. To this end, the structure and function of hinge 20 will now be described.

Figure 1:
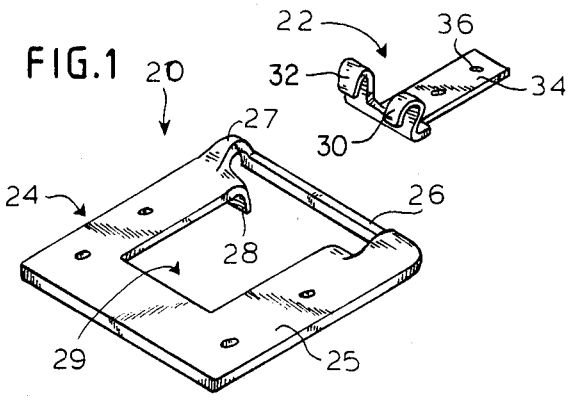
FIG. 1 is a perspective view of the present hinge wherein the hooked strap is detached from the hinge base.
Figure 10:
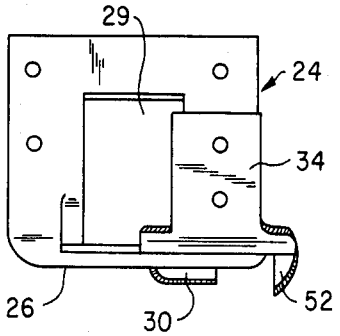
FIG. 10 is a top view of a hinge wherein the strap plate has a wide hook and a narrow hook.

FIG. 1 illustrates the two components of hinge 20, hooked straps 22 and hinge base 24. A hooked strap 22 comprises plate 34 having apertures 36 which are adapted to enable affixation of the hook strap to a casket lid, and hooks 30 and 32. While the hooks are of equal width in the preferred embodiment, it could be understood that one may be narrow and the other wide as shown in FIG. 10 where hook 50 is a wide hook and hook 52 is a narrow hook. The wide hook should be of sufficient width to individually hingedly couple and provide rotational support to the casket lid when in the spaced mounting. Hinge base 24 comprises hinge or base plate 25 having apertures for receiving a screw or bolt, support bar 26, arcuate rib 27 which protrudes vertically in an upward direction relative to base plate 25, and arcuate edges 28 which protrude downwardly from base plate 25.

Figure 2:
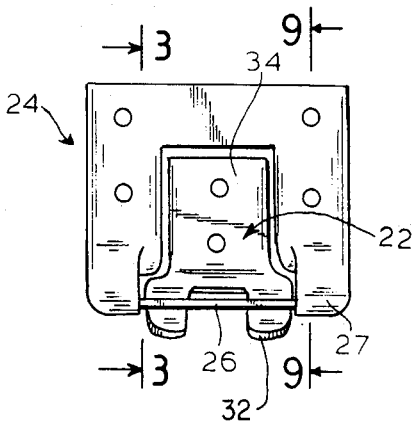
FIG. 2 is a top view of the present hinge wherein the hooked strap is attached to the hinge base in its normal or closed position.

FIG. 2 illustrates hooked strap 22 mounted on support bar 26 of hinge base 24 in a manner which allows entire closure of casket lid 14 so that the lid rests flush with the container as illustrated in FIG. 6. Note that hooks 30 and 32 are mounted on support bar 26 such that strap plate 34 is aligned with aperture 29 within the hinge base.

Figure 3:
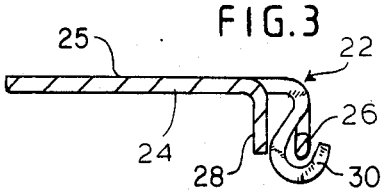
FIG. 3 is a section view of the hooked strap to hinge base attachment taken along line 3—3 of FIG. 2.

FIG. 3 illustrates the mounting of the hooks on support bar 26. This mounting allows free rotation of the strap 22 about the support bar and maintains the lid flush with base 12.

Figure 4:
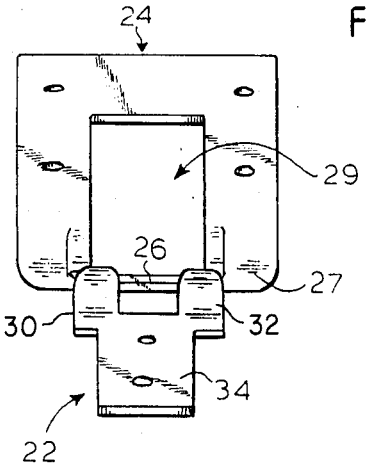
FIG. 4 is a top view of the present hinge wherein the hooked strap is attached to the hinge base and the hooked strap is rotated in an outward position.

FIG. 4 illustrates strap 22 in a position in which it is rotated outwardly from the hinge base. This figure illustrates the free rotation allowed by the mounting of hook strap 22 in alignment with aperture 29 of the hinge base.

Figure 5:
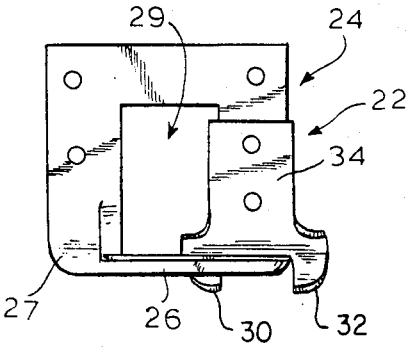
FIG. 5 is a top view of the present hinge in a laterally displaced position which is adapted to maintain a casket lid in a laterally spaced relation to a casket body.
Figure 8:
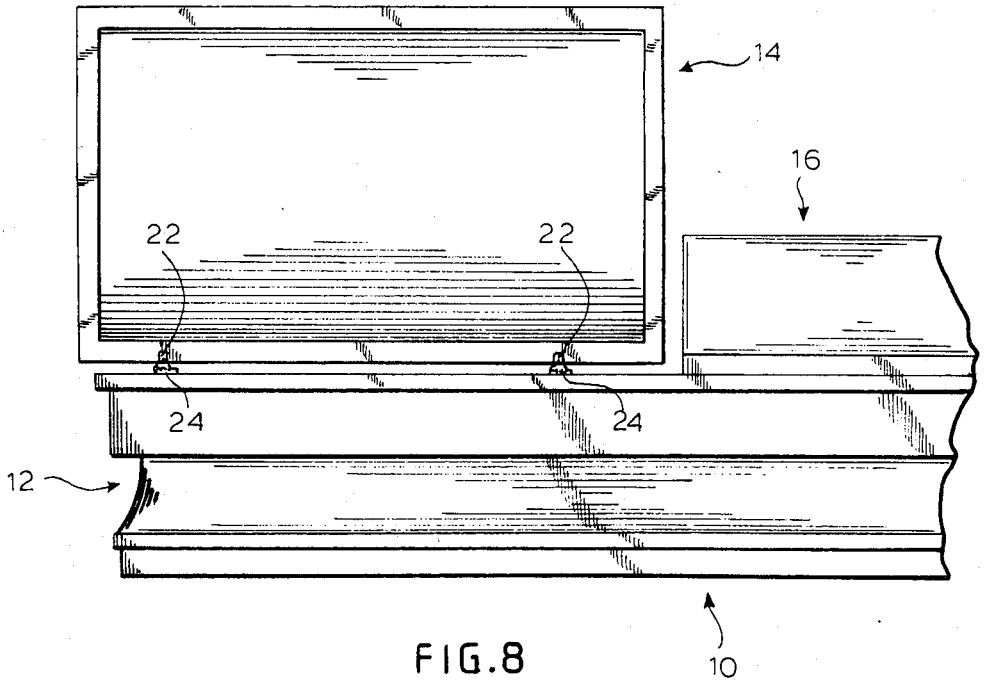
FIG. 8 is a rear view of a casket employing the present hinge wherein the hooked strap is in a laterally displaced condition as shown in FIG. 5.

FIG. 5 illustrates an alternate mounting of hinge 20. When hooked strap 22 is mounted upon hinge base 24 in a manner shown in FIG. 5, the casket lid 14 is maintained in a spaced relation to casket lid 16 as illustrated in FIGS. 8 and 9. It is in this postion that proper surface treatment and drying of an entire casket including casket body and casket lid may be accomplished. To achieve the space mounting as shown in FIG. 5, the casket lid is first removed from the casket base by lifting hooked strap 22 from hinged base 24 as shown in FIG. 7. The casket lid is then laterally displaced along the axis of support bar 26, then reset in a mounted position upon the support bar so that hook 32 is wrapped around the support bar 26 while hook 30 is located without the hinge base. In this mounting hooked strap 22 rests upon the vertically protruding arcuate rib 27 of the hinge base so that casket lid 14 remains vertically spaced from casket base 10. Hooks 30 and 32 to extend below support bar 26 and wrap therearound. Arcuate rib 27 of the hinge plate 25 is raised vertically above hinge plate 25 and supports hook strap 22 in a raised position thus accomplishing the spaced mounting illustrated in FIG. 8. Hooks 30 and 32 of the hooked strap are vertically raised from strap plate 34 a sufficient amount to enable strap plate 34 to obtain a substantially horizontal position when the casket lid is closed in the spaced mounting position. Consequently, this mounting position enables the opening and closing of casket lid 14 in much the same manner as with the mounting shown in FIG. 2. As can be appreciated from the above, the present hinge provides rotational movement in a plane perpendicular to the axis of support bar 26 in both the flush and spaced mounting positions. Lateral displacement, which is not available in prior art hinges, is possible with the present hinge thereby enabling the alternate mounting method of the present invention.

The procedure employed in surface treating a casket shell using the present hinge involves the following steps: hinge normally (flush mounting) to determine lock hole location, then punch out the lock hole; shift the lid to the spaced mounting; paint and lacquer, then bake; shift lid to flush position. FIG. 9 is a side elevation view of the hinge in the spaced mounting of FIG. 5. Strap plate 34 preferably contacts arcuate rib 27 to maintain strap plate 34 spaced from and parallel to hinge plate 25. In this mounting casket lid 14 is maintained vertically spaced from casket base 12 and laterally spaced from lid 16 as shown in FIG. 9.

The present hinge may be composed of any sufficiently sturdy material preferably a desired grade of sheet steel. To manufacture the present hinge flat hinge blanks for the hooked strap and hinge base are press formed, then folded to their desired configuration.

Thus, it will be evident that the present invention realizes the object of providing dual mounting, one mounting enabling conventional closing of a casket lid onto a casket base, the other mounting enabling a closing of the casket lid while it is maintained in spaced relation to casket base 10. Although, a preferred embodiment of the invention has been disclosed and described in detail herein, it should be understood that this invention is in no sense limited thereby and its scope is to be determined by that of the appended claims.

What is claimed is:

1. A burial casket comprising:

a casket base;

a lid member;

a hinge hingedly coupling the lid member to the casket base and adapted for two mountings, a first mounting wherein the lid is flush with the base when closed, and a second mounting wherein the lid is vertically spaced from the base when closed, the hinge comprising a strap means having at least two hook means affixed at a forward end thereof, and a hinge base having a support bar at a forward end thereof, and a substantially flat base plate having an aperture in a center portion thereof which is adapted to receive the strap means, and a raised arcuate rib portion which protrudes upwardly from the substantially flat base plate to provide an abutment means for maintaining the lid spaced from the casket base; and a second lid member wherein said hinge means is adapted to maintain said second lid member in a position contiguous to the first lid member in the first mounting position, and in a position laterally displaced from the first lid member in the second mounting position.

2. A hinge for hingedly coupling a lid to a base adapted for use in two separate mountings comprising:

a strap means having a forward end for hingedly coupling to a hinge base and a rearward end for affixing to the lid, the strap means having a substantially flat strap plate and at least two hook means affixed to the forward end thereof, said hook means being laterally spaced from one another; and the hinge base hingedly coupled to the strap means having a forward end for hingedly coupling to the strap means and a rearward end for coupling to the base, the hinge means having a support bar affixed at the forward end thereof, and a substantially flat base plate which comprises an aperture which is adapted to receive the strap means in a center portion thereof, the aperture in the plate means being wider at a forward end to accommodate the hook means, and narrower toward the rearward end to accommodate the strap plate, the aperture being adapted to circumscribe the strap plate.

3. A hinge according to claim 2 wherein a portion of the base plate slopes downwardly at the forward end of the base plate to create the wider aperture adapted to receive the hook means.

4. A hinge for hingedly coupling a lid to a base adapted for use in two separate mountings comprising:

a strap means having a forward end for hingedly coupling to a hinge base and a rearward end for affixing to the lid, the strap means having a substantially flat strap plate and at least two hook means affixed to the forward end thereof, said hook means being laterally spaced from one another;

the hinge base having a forward end for hingedly coupling to the strap means and a rearward end for coupling to the base, the hinge base having a support bar affixed at the forward end thereof, and a substantially flat base plate which comprises an aperture which is adapted to receive the strap means in a center portion thereof;

a raised arcuate rib portion at the forward end of the hinge base which protrudes upwardly therefrom and is adapted to contact the strap plate in one of the mountings; and said hook means are spaced apart a distance greater than the width of the arcuate rib portion so that the strap means and hinge base are adapted for a first and a second mounting; the first mounting wherein the strap means is mounted on the hinge base so that more than one of said hook means is coupled to the support bar and the second mounting, wherein a first of said hook means is mounted on the support bar and received within the aperture in the base plate and a second of said hook means is maintained outside of the aperture in the base plate and wherein the arcuate rib portion is laterally positioned between the spaced hook means.

5. A hinge in accordance with claim 4 wherein the first hook means, mounted within the aperture in the hinge plate over the arcuate rib portion, is a wide hook, and the second hook means, mounted outside of the aperture, is a narrow hook.

6. A hinge in accordance with claim 4 wherein the base plate is substantially flat and having two generally C-shaped members having forward points, and wherein the support bar, positioned at a level substantially planar with the hinge plate, connects with the forward points of the C-shaped member, closing the forward end of the C and wherein the arcuate rib is located on the hinge plate at the juncture of the hinge plate with the support bar, and wherein the strap plate is substantially flat.

* * * * *